US006430785B1

(12) United States Patent
Matsushima et al.

(10) Patent No.: US 6,430,785 B1
(45) Date of Patent: Aug. 13, 2002

(54) ZIPPER PULL OF SLIDER FOR SLIDE FASTENER

(75) Inventors: Hideyuki Matsushima; Hisashi Yoneshima, both of Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/675,675

(22) Filed: Sep. 29, 2000

(30) Foreign Application Priority Data

Sep. 30, 1999 (JP) ..... 11-279946

(51) Int. Cl.[7] ..... A44B 11/25

(52) U.S. Cl. ..... 24/429; 24/423; 24/424; 24/430; 24/431

(58) Field of Search ..... 24/429, 430, 431, 24/423, 424

(56) References Cited

U.S. PATENT DOCUMENTS

| | | | | |
|---|---|---|---|---|
| 1,609,081 A | * | 11/1926 | Freysinger | 24/429 |
| 2,262,188 A | | 11/1941 | Marinsky | |
| 2,269,585 A | * | 7/1942 | Marinsky | 24/205.5 |
| 2,307,711 A | | 1/1943 | Schaaff | |
| 2,316,133 A | | 4/1943 | Schaaff | |
| 2,520,496 A | * | 8/1950 | Deutsch | 24/205.14 |
| 2,540,485 A | * | 2/1951 | Kellum | 24/205.14 |
| 2,882,576 A | * | 4/1959 | Morin | 24/205.14 |
| 5,101,538 A | * | 4/1992 | Dieter | 24/429 |
| 5,105,512 A | | 4/1992 | Aussedat | |
| 5,729,874 A | * | 3/1998 | Mizuno | 24/429 |
| 5,771,546 A | * | 6/1998 | Minato | 24/429 |

FOREIGN PATENT DOCUMENTS

| | | |
|---|---|---|
| EP | 0280071 | 8/1988 |
| GB | 2187230 A * | 9/1987 |

* cited by examiner

*Primary Examiner*—Anthony Knight
*Assistant Examiner*—André L. Jackson
(74) *Attorney, Agent, or Firm*—Finnegan, Henderson, Farbow, Garrett & Dunner, LLP

(57) ABSTRACT

An object of this invention is to provide a zipper pull of resilient body which is attached to a slider in a lateral direction thereof and capable of sliding the slider by rotating the zipper pull slightly so that the zipper pull is held in a stabilized state. A zipper pull mounting portion is provided on a top surface of a slider body and a connecting body of a zipper pull is disposed in a lateral direction relative to the mounting portion. The connecting body is comprised of two lateral bars disposed in parallel and vertical bars connected to both ends thereof so as to be protruded longitudinally. One of the vertical bars is buried in the zipper pull of resilient body so as to form a fixing portion. The zipper pull has an annular shape for surrounding the slider body. The lateral bars of the connecting body are inserted into the mounting portion. When a free end of the zipper pull is lifted up, the fixing portion is rotated and at the same time, the free vertical bar of the connecting body is lifted up, so that a locking pawl lever of automatic locking mechanism connected to the lateral bars is lifted up, thereby allowing the slider to slide. When the slider is locked, the zipper pull is fallen onto the slider body so that it can be maintained in a stabilized condition without swinging freely.

16 Claims, 12 Drawing Sheets

ZIPPER PULL OF SLIDER FOR SLIDE FASTENER

BACKGROUND OF THE INVENTION

1. Field of the Invention

The present invention relates generally to a zipper pull of slider for slide fastener for use behind a fly of mainly a front-open clothes such as a training wear and jacket, and more particularly to a zipper pull of a slider for slide fastener, the zipper pull being formed of a resilient body and urged so as to be fallen onto a slider body in a horizontal state relative thereto, thereby maintaining a stabilized state in which the zipper pull does not swing freely when the clothes is worn.

2. Description of the Related Art

As shown in FIG. 15, a conventional slider zipper pull 2' is formed of resilient member 33' fixed to a connecting body 3' pivotally moved in the same direction as a sliding direction of the slider body 1'. The resilient member 33' is capable of moving and fitting in the resilient member 33' itself with a gap and the connecting body elastically in the longitudinal direction on substantially the same plane as the slider at their locking position. The connecting body 3' comprises a first end portion 3'-1 which is pivotally moved on the slider and a second end portion 3'-2 fixed to the resilient member 33'.

The resilient member 33' has a free end portion 30' which is disposed at a position apart from the second end portion 3'-2. The free end portion 30' of the resilient member 33' and the second end portion 3'-2 of the connecting body 3' are located oppositely each other at both ends of the slider at a locking position of the slider. Further, the first end portion 3'-1 of the connecting body 3' is disposed between the second end portion 3'-2 and the free end portion 30' of the resilient member 33'. Such a slider for slide fastener has been disclosed in U.S. Pat. No. 5,101,538.

In the zipper pull 2' of the above described slider for slide fastener shown in FIG. 15, when it is intended to close the slide fastener by sliding the slider in the longitudinal direction, the ring-like zipper pull 2' of resilient member 33' must be pulled forward. At that time, the zipper pull 2' must be pulled forward such that the resilient member 33' is turned substantially at 180° between the free end portion 30' and the second end portion 3'-2 fixed to the connecting body 3'. Further, when the zipper pull 2' is pulled backward to intend to separate and open the slide fastener, the resilient member 33' is also turned substantially at 180° between the free end portion 30' and the second end portion 3'-2 fixed to the connecting body 3' to slide the slider backward. For these reasons, there is a fear for the ring-like resilient member 33' that a turning load is borne onto the second end portion 3'-2 fixed to the connecting body 3' so that the resilient member 33' may be damaged. Thus, this kind of the zipper pull of the slider for slide fastener cannot bear a long term use.

SUMMARY OF THE INVENTION

Accordingly, the present invention has been achieved in views of the above described problems. An object of the invention is to provide a zipper pull of a slider for slide fastener, wherein by rotating the zipper pull of resilient body attached to a slider body with a connecting body by a slight rotation in a direction perpendicular to a sliding direction of the slider and then pulling it, the slider fastener is opened or closed. More specifically, the main object of the invention is to provide such a zipper pull of a slider for slide fastener, wherein the slide fastener can be opened or closed without much turning of the resilient body, so that the zipper pull is prevented from being damaged by the twisting and capable of bearing a long term use and maintains a stabilized state without swinging freely, thereby providing no discomfort to user of the slider fastener.

Another object of the invention is to provide a zipper pull of resilient body adaptable for various types of the sliders by specifying the configuration of the zipper pull formed of resilient body to be mounted on the slider body.

And another object of the invention is to provide a connecting body of a zipper pull of a slider for slide fastener, wherein by specifying the configuration of the connecting body for attaching the zipper pull made of an annular or sheet-like resilient body to the slider body, the zipper pull of various types of the resilient body is fixed in a stable state by various types of the connecting body so as to achieve an endurance on a long term use.

Also another object of the invention is to provide a zipper pull of a slider for slide fastener of resilient body, wherein by specifying the configuration of the annular or sheet-like zipper pull to be mounted on the slider body, the zipper pull is adaptable for various types of the connecting body and maintained in a stabilized condition so as to ensure an easiness of operation.

Further object of the invention is to provide a zipper pull of resilient body which can be produced in various types thereof simply and easily by specifying material of the annular or sheet-like zipper pull made of resilient body.

To achieve the above object, according to the main aspect of the present invention, there is provided a zipper pull of a slider for slide fastener, wherein a zipper pull mounting portion for mounting a zipper pull is always provided on a top face of a sliding body; a connecting body is disposed in a lateral direction relative to the zipper pull mounting portion or in a direction perpendicular to a sliding direction of the slider; and the zipper pull formed of resilient body having an appropriate shape is fixed on any side of the right or left of the connecting body so as to form a fixing portion so that the zipper pull is urged to be always fallen on a top face of the slider body. A state in which the zipper pull is urged to be always fallen on the top face of the slider body refers to a state in which the zipper pull is disposed substantially in parallel to the top face of the slider body.

Preferably, the zipper pull made of resilient body to be fixed to the connecting body is formed in an annular shape having an appropriate shape and a part of the annular portion is fixed to a vertical bar provided on the connecting body so as to form a fixing portion.

Alternatively, the zipper pull made of resilient body to be fixed to the connecting body is formed in a sheet-like shape having an appropriate shape and a part of the sheet-like portion is fixed to a vertical bar provided on the connecting body so as to form a fixing portion.

Preferably, the connecting body for connecting the zipper pull of resilient body to the slider body is comprised of two lateral bars disposed with an interval and being capable of being inserted into the zipper pull mounting portion provided on a top face of the slider body, and vertical bars molded integrally with the lateral bars and being protruded in back and forth direction from each of both ends of the lateral bars.

Also preferably, the connecting body for connecting the zipper pull of resilient body to the slider body places the fixing body at which the zipper pull of resilient body is fixed to contact thereon.

Preferably, the connecting body for connecting the zipper pull of resilient body to the slider body disposed the vertical bar on one side of the lateral bars and the lateral bars of U letter shape are connected to the vertical bar while protrusions provided on the top surface of the slider body are fitted in between the lateral bars disposed on the right and left of the mounting portion provided on the top surface of the slider body.

Further preferably, the connecting body, which connects the zipper pull of resilient body to the slider body, has an annular supporting portion to which the mounting portion can be fitted provided on the top surface of the sliding body in a floating state, a restricting portion protruded over the top surface of the slider body is provided on the outer side of the supporting portion and the fixing portion at which the zipper pull of resilient body is fixed is provided on an opposite side to the restricting portion.

Preferably, the connecting body, which connects the zipper pull of resilient body to the slider body, is comprised of a lateral bar and vertical bars connected to both ends thereof, engaging portions are provided on one outer side of the vertical bar such that they are protruded outward thereof, and the zipper pull of resilient body is fixed to the engaging portions by means of a mounting ring.

Also preferably, the lateral bars provided laterally to the connecting body, which connects the zipper pull of resilient body to the slide body, are inserted into an automatic locking pawl lever provided within a yoke mounted on the top surface of the slider body so that the locking pawl lever is capable of being lifted up.

Preferably, the vertical bar disposed on one side of the connecting body is buried and fixed in the zipper pull of resilient body connected to the connecting body, so as to form the fixing portion.

Preferably, the zipper pull of resilient body connected to the connecting body contains narrow or concave neck portions, which is easily to be elastically deformed, in a longitudinal direction in the center of the slider body.

Preferably, the zipper pull of resilient body connected to the connecting body contains a grip portion whose diameter is increased or which has an increased thickness on an opposite side to the fixing portion in which the connecting body is fixed.

Also preferably, the zipper pull of resilient body connected to the connecting body, protrudes obliquely forward on an opposite side to the fixing portion formed in an annular shape and in which the connecting body is fixed, and contains a grip portion whose space is expanded.

Further preferably, the zipper pull of resilient body connected to the connecting body is formed in annular D letter or inverted D letter shape and contains a grip portion which has a space longitudinally on an opposite side to the fixing portion in which the connecting body is fixed.

Alternatively, the zipper pull of resilient body is formed in a sheet-like shape and raised substantially from the fixing portion fixed to the connecting body and bent to cover the mounting portion so as to form a bent portion.

Preferably, the zipper pull of resilient body, which is connected to the connecting body, is formed and molded integrally with natural rubber, synthetic rubber or thermoplastic elastomer.

DESCRIPTION OF THE PREFERRED EMBODIMENTS

Figure 1:
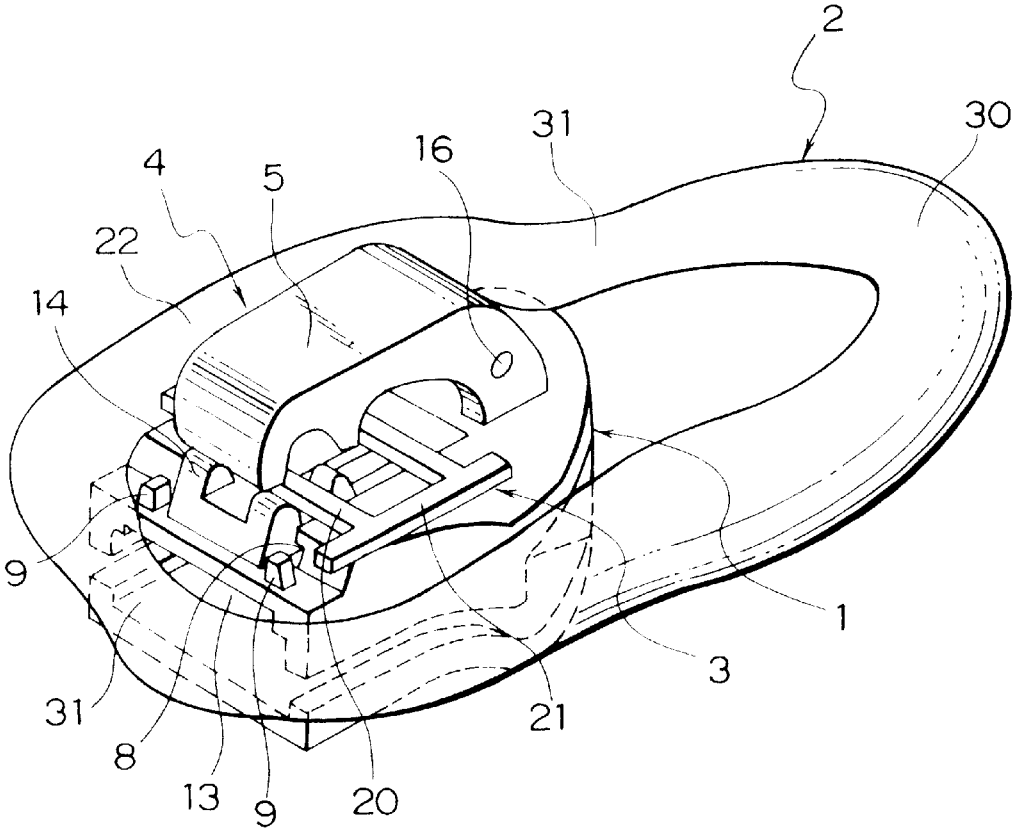
FIG. 1 is a perspective view of a slider having a zipper pull of a slider for slide fastener of a first embodiment.
Figure 2:
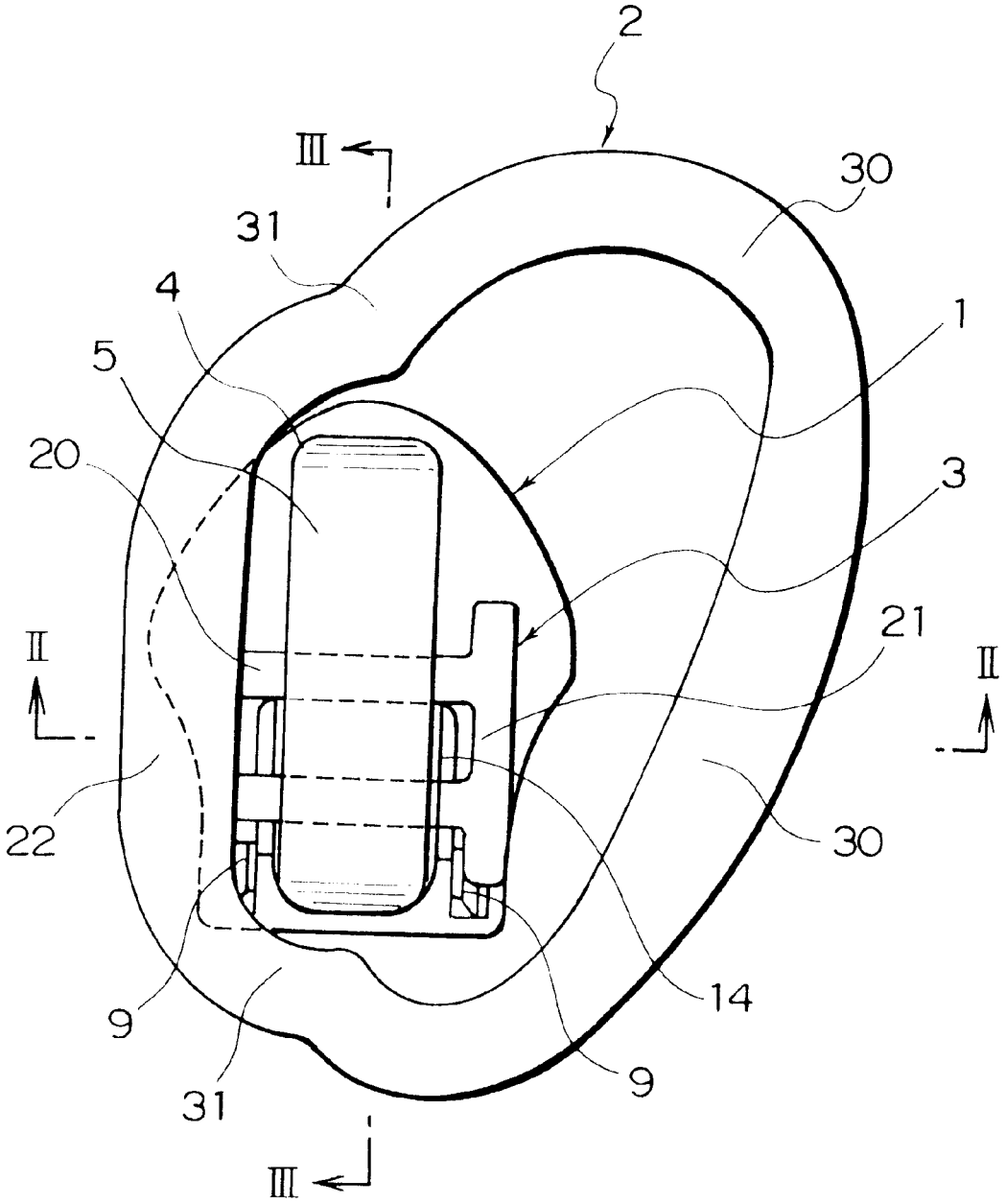
FIG. 2 is a front view of the slider of FIG. 1.
Figure 3:
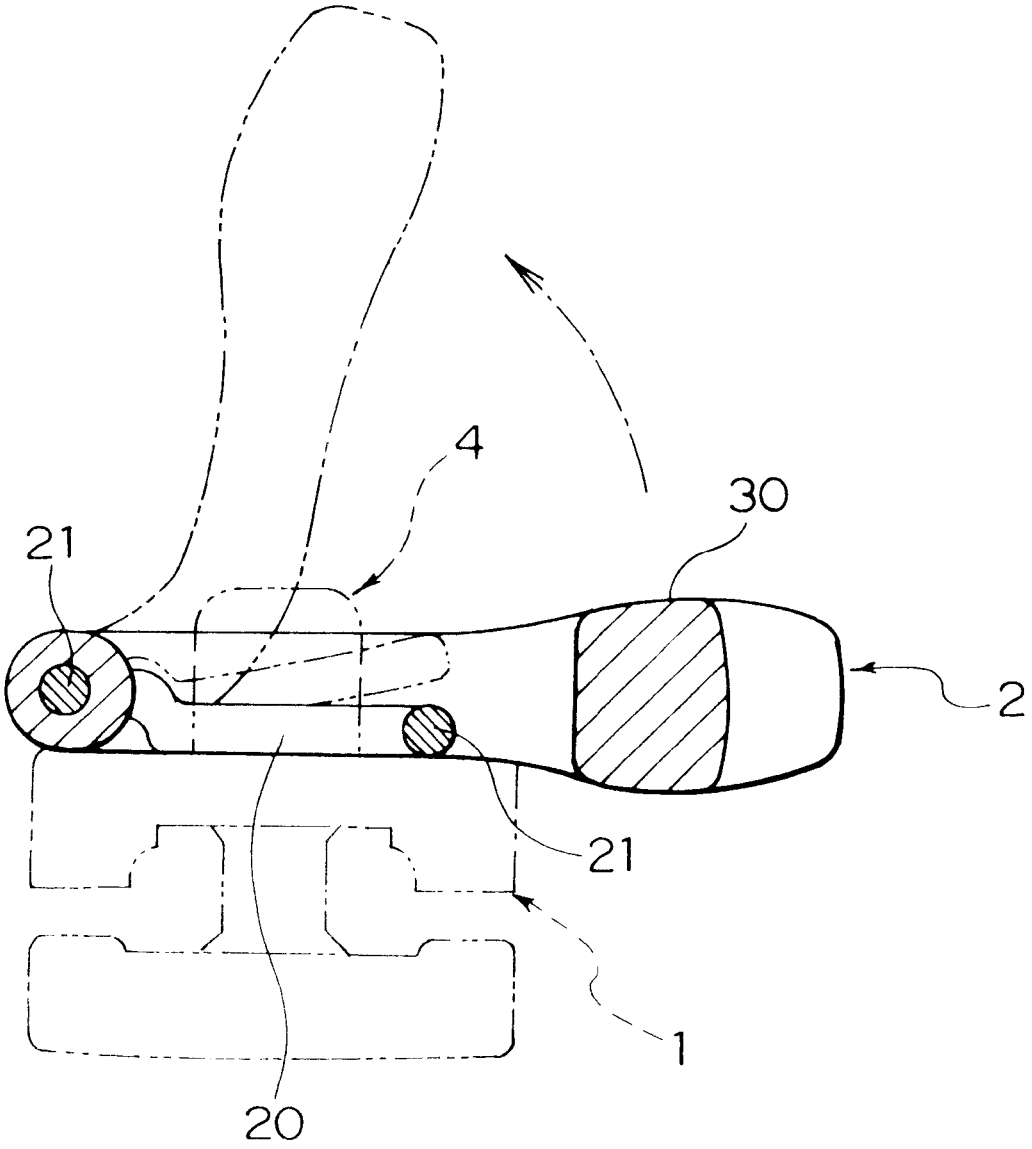
FIG. 3 is a sectional view taken along the line in II—II FIG. 2 of the zipper pull of the slider.
Figure 4:
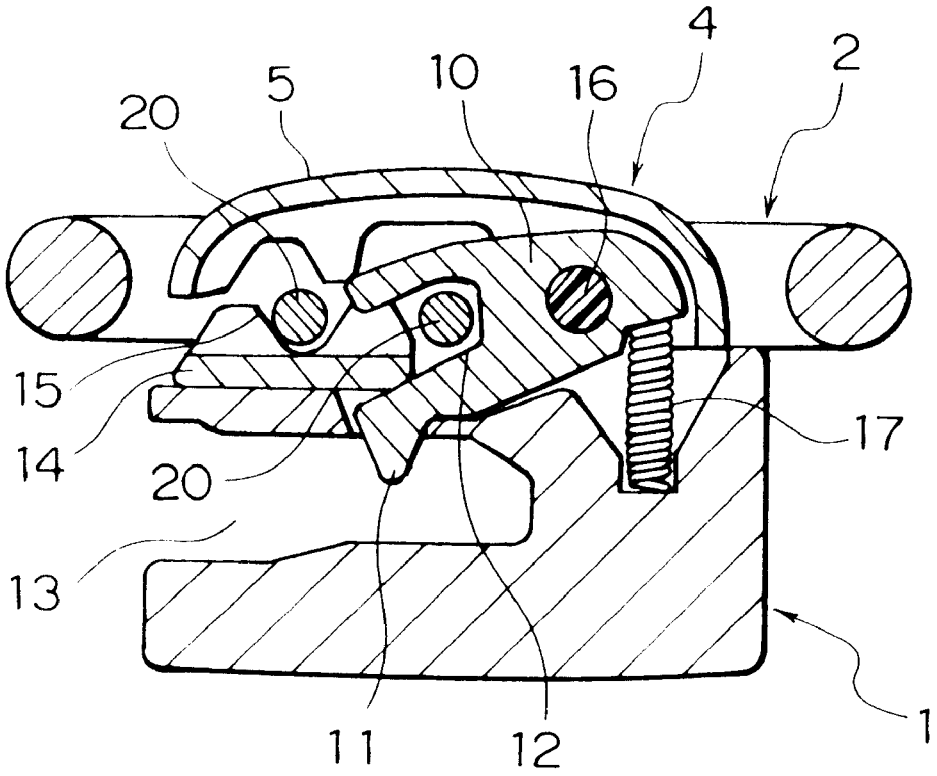
FIG. 4 is a sectional view taken along the line III—III in FIG. 2 of the slider.

Hereinafter, the preferred embodiment of a zipper pull of a slider for slide fastener of the present invention will be described in detail with reference to the accompanying drawings.

What is common in structure of each of all embodiments of the zipper pull of a slider for slide fastener of the present invention is, a zipper pull 2 made of a resilient body having an appropriate shape mounted to a zipper pull mounting portion 4 provided in a longitudinal direction in the center of a top surface of a slider body 1 through a connecting body 3. The connecting body 3 is mounted so as to be movable slightly round in a direction perpendicular to the mounting portion 4 or a lateral direction. An annular or sheet-like zipper pull 2 made of a resilient body is fixed on one side of the right or left side of this connecting body 3 and the zipper pull 2 is urged so as to be fallen onto a top surface of the body 1 so that the zipper pull 2 is prevented from swinging freely.

The zipper pull of a slider for slide fastener of the first embodiment shown in FIGS. 1 to 4 is installed on a slider provided with an automatic locking device. A yoke 5 which is the zipper pull mounting portion 4 is installed in a longitudinal direction in the center of a top surface of the slider body 1. The yoke 5 is pivoted on a mounting post provided in a front portion of the slider body 1 with a supporting shaft 16. An automatic locking pawl lever 10 having a locking pawl 11 protruding downward from a rear end thereof is supported by this supporting shaft 16 within the cover body 5. The automatic locking pawl lever 10 has a concave portion 12 above the locking pawl 11 provided laterally and a coil spring 17 disposed in the slider body 1 is in an elastic contact with a front end of the locking pawl lever 10, so that the locking pawl 11 is always protruded into a guide groove 13 provided in the slider body 1.

The connecting body 3 is comprised of two lateral bars 20 which can be inserted laterally into the cover body 5 which is the zipper pull mounting portion 4, the two bars being arranged in parallel with a gap and a vertical bar 21 connected to ends of both lateral bars 20 so as to be protruded back and forth relative to the lateral bars 20. By making the vertical bar 21 protruded from the lateral bars 20 back and forth, a decline in the back and forth directions of the connecting body 3 can be restricted. Then, the connecting body 3 is molded integrally by die-casting with aluminum alloy or zinc alloy.

The zipper pull 2 is formed of a resilient body and integrally molded of such a resilient body as raw rubber, synthetic rubber and thermoplastic elastomer. Upon molding, the vertical bar 21 on one side of the connecting body 3 is buried in the resilient body so as to form a fixing portion 22 by fixing the zipper pull 2 onto the connecting body 3 firmly. The zipper pull 2 is formed in an annular shape and the fixing portion 22 in which the vertical bar 21 of the connecting body 3 is buried is formed linearly substantially in the length of the slider body 1. Then, the zipper pull 2 is formed such that it surrounds the slider body 1 and protrudes obliquely forward in front of the slider body 1 so that a space portion is expanded, thereby facilitating an insertion of the finger thereinto and gripping of the gripping portion 30. Further, in a part of the zipper pull 2 located downward on a side of the slider body 1, the grip portion 30 whose resilient body is expanded in the diameter is formed, so that it can be gripped easily when the slider is slid backward. Further, a neck portion 31 which narrows in diameter is provided at each of portions opposing the front and back in the longitudinal direction in the center of the slider body 1, so that the zipper pull 2 of resilient body can be elastically deformed easily.

The connecting body 3 integral with the zipper pull 2 of resilient body is mounted on the slider body 1 as follows. A concave groove 8 like a dovetail groove is provided in a top face of the slider body 1 from a rear end of the slider body 1. A sliding body 14 capable of sliding back and forth is fitted into the concave groove 8. The sliding body 14 has protruded portions which are protruded from both sides of a bottom portion thereof and fits into the concave portion 8 free-slidably. A coil spring is disposed between the sliding body 14 and the mounting post on which the yoke 5 is mounted so that the sliding body 14 is elastically urged toward the rear end. Further, a recess 15 capable of accommodating the lateral bar 20 located at the rear of the connecting body 3 is provided in the top surface of the sliding body 14. The lateral bar 20 located in front is inserted into the concave portion 12 provided in the locking pawl lever 10. A front portion of yoke 5 is pivoted on a mounting post with the supporting shaft 16 and a rear portion of the yoke 5 is formed such that it is open and can be fit into the concave groove 8 with the lateral bars 20 being inserted into a recess 15 of the sliding body 14. After the sliding body 14 is inserted into the concave groove 8, sealing protrusions 9 provided at an entrance of the concave groove 8 are crushed to seal part of the concave groove 8 thereby preventing the sliding body 14 from slipping out of the concave groove 8. At the same time, the fixing portion 22 in which the connecting body 3 is buried is brought into a contact with the top surface of the slider body 1. Consequently, assembly of the slider with the automatic locking device is completed.

An operation of the slider will be described. When it is intended to close the fastener chain, the finger is inserted into the grip portion 30 of the zipper pull 2, and the zipper pull 2 is pulled forward. Then, the zipper pull 2 of resilient body is raised through the neck portion 31 so that a force for rotating the fixing portion 22 which fixes the resilient body and a force for lifting up the zipper pull 2 act at the same time. Consequently, with these actions, the free vertical bar 21 of the connecting body 3 is lifted slightly above the top surface of the slider body 1 and simultaneously the locking pawl lever 10 within the yoke 5 is lifted up. Then, the locking pawl 11 is escaped from the guide groove 13 so that the slider is capable of sliding forward. Meanwhile, even when the locking pawl 11 is protruded slightly in the guide groove 13, the coil spring 17 is compressed by fastener elements depending on the shape of the locking pawl lever 10 so that the slider can be slid forward.

When the slider is locked and the finger is released from the grip portion 30 of the zipper pull 2, the zipper pull 2 is fallen onto the top surface of the slider body 1 by a restoration force of the resilient body. At the same time, the connecting body 3 also comes into contact with the top surface of the slider body 1. The locking pawl 11 of the locking pawl lever 10 is protruded into the guide groove 13 by an elastic force of the coil spring 17 so that the locking pawl 11 is inserted between the fastener elements thereby automatically locking the slider. Consequently, the zipper pull 2 is maintained in a state in which it is fallen onto the slider body 1 and in contact therewith, so that the zipper pull 2 is held without swinging freely.

Next, when it is intended to separate and open the fastener chain, the grip portion 30 of the zipper pull 2 is gripped so as to lift up the zipper pull 2 slightly and then, the zipper pull 2 is pulled backward. Then, the zipper pull 2 of resilient body rotates the fixing portion 22 by a force of lifting up. The connecting body 3 lifts up the free vertical bar 21 slightly from the top surface of the slider body 1 by such an action and at the same time, the locking pawl lever 10 is also lifted up. Consequently, the locking pawl 11 is escaped from the guide groove 13 so that the slider can be slid backward.

As described above, when the zipper pull 2 made of annular resilient body is lifted up slightly against an elastic force of the resilient body, the slider can be slid. Further, if the fingers are released from the zipper pull 2, the zipper pull 2 is automatically fallen onto the top surface of the slider body 1 by an elastic force of the resilient body. Moreover, as long as an external force is not applied to the zipper pull 2, the zipper pull 2 is maintained on the slider body 1 so that it is maintained stably without swinging freely.

Figure 5:
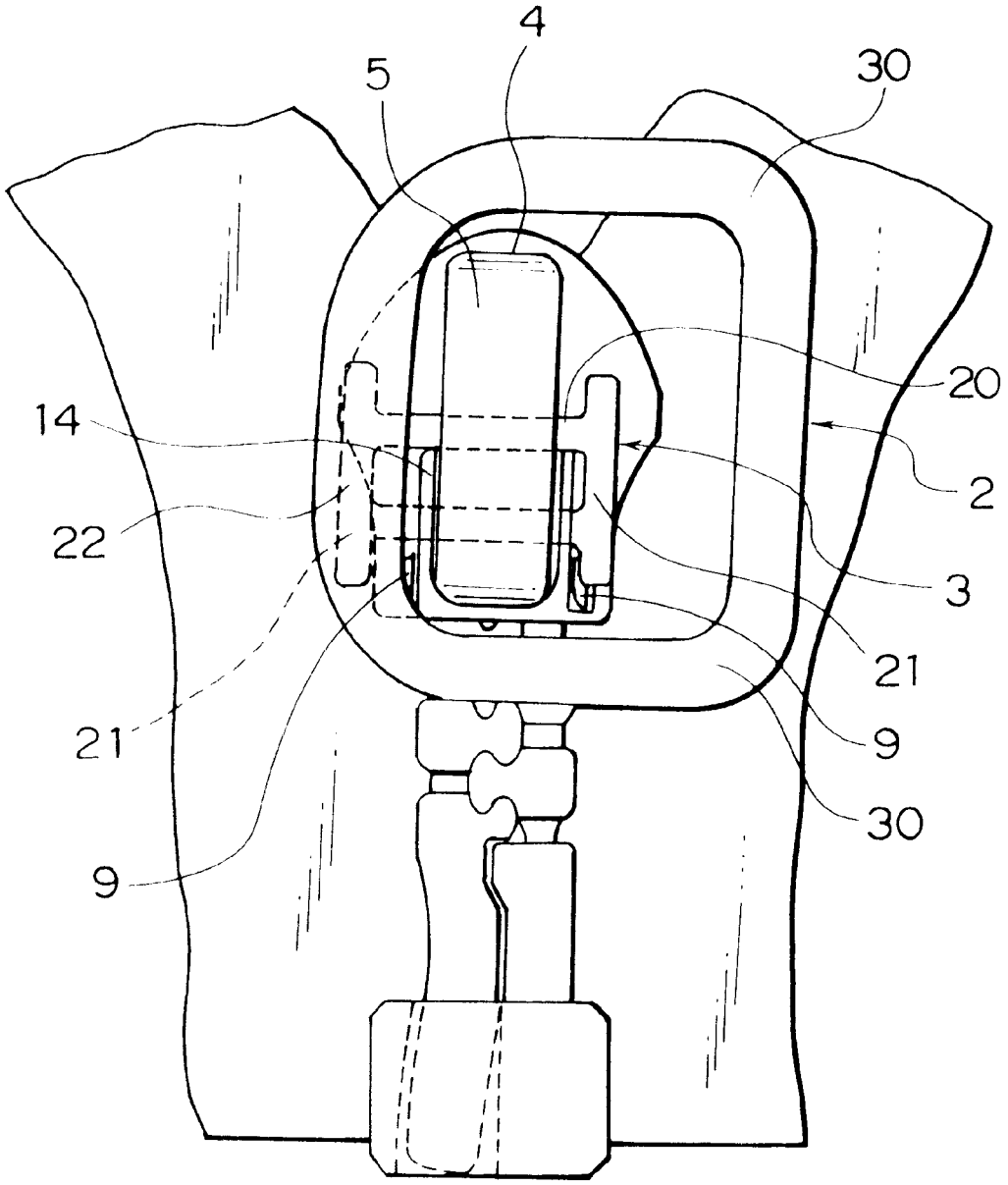
FIG. 5 is a front view of a fastener chain having a zipper pull of a slider for slide fastener of a second embodiment.

Next, a zipper pull of a slide fastener according to a second embodiment shown in FIG. 5 will be described. This slider has the same configuration as the previously described example except that the shape of the zipper pull 2 is different. The zipper pull 2 is formed in inverted D letter shape using annular resilient body and the vertical bar 21 of the connecting body 3 is buried integrally in a curved portion thereof so as to form the fixing portion 22. By providing a side opposite to the fixing portion 22 with a wide space vertically, the grip portion 30 is formed, so that the grip portion is easy to grip from any direction. Thus, the zipper pull 2 of this slider aims at securing easiness of operation.

Figure 6:
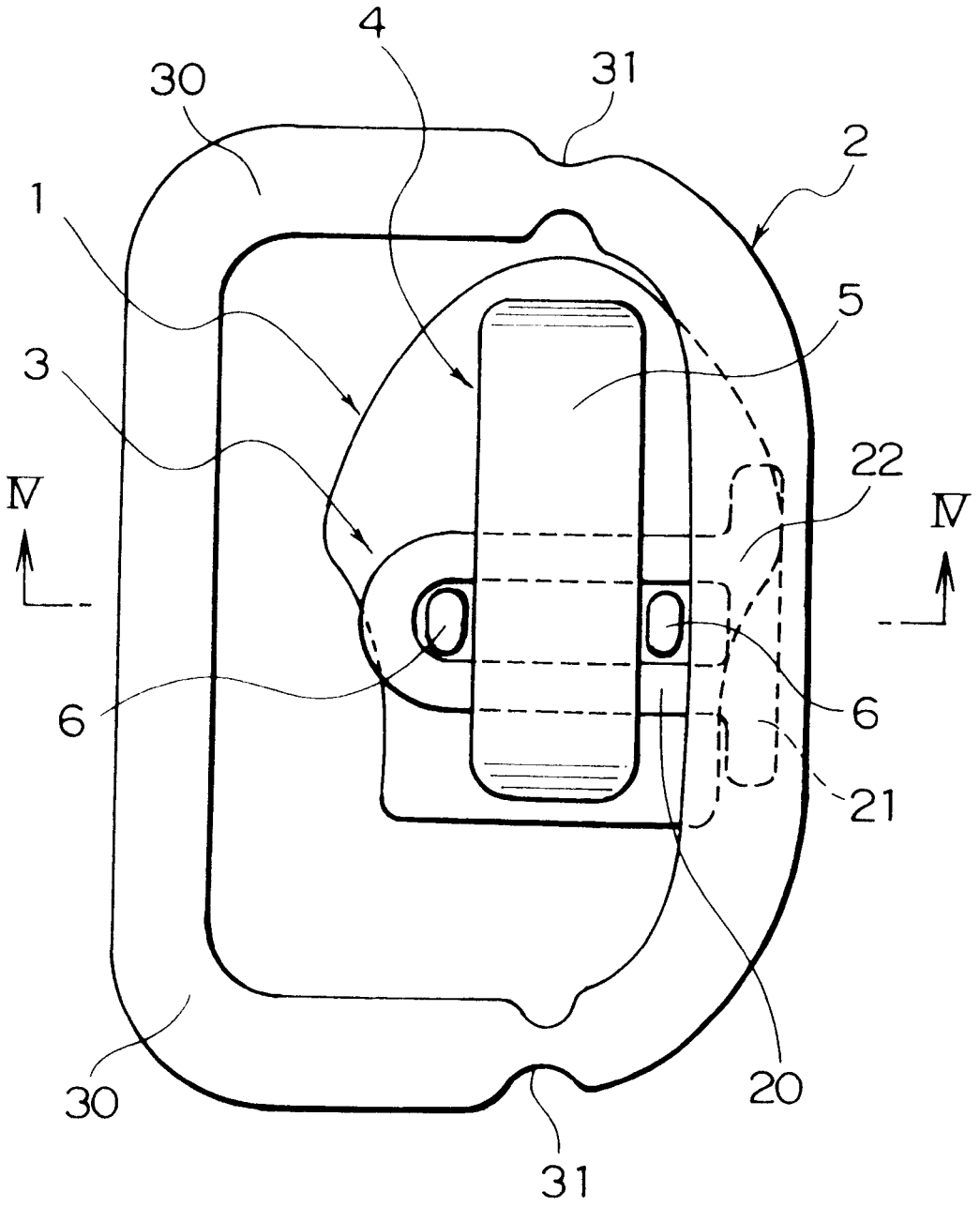
FIG. 6 is a front view of a fastener chain having a zipper pull of a slider for slide fastener of a third embodiment.
Figure 7:
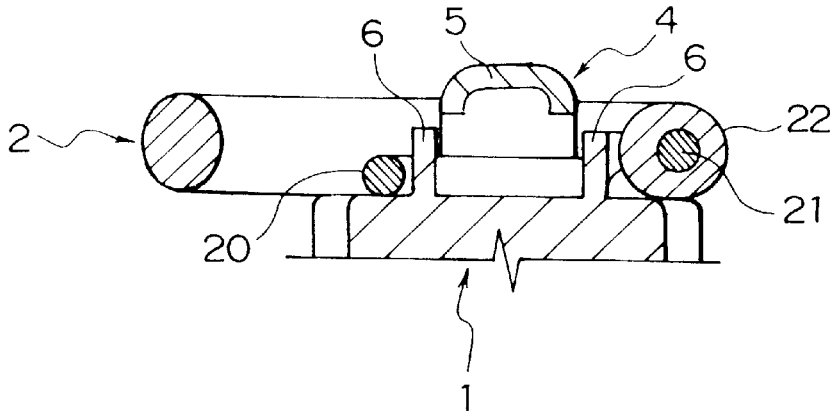
FIG. 7 is a sectional view taken along the line IV—IV showing major portions of the slider of FIG. 6.

Next, a zipper pull of a slider according to a third embodiment shown in FIGS. 6 and 7 will be described. The lateral bars 20 of the connecting body 3 are formed in a U letter shape as a whole and the vertical bar 21 is connected integrally to ends of the lateral bars 20 in the U letter shape. This vertical bar 21 is buried in a curved portion of an annular zipper pull 2 of resilient body formed in the D letter shape so as to form the fixing portion 22. Then, the grip portion 30 is formed such that a wide space is expanded vertically on an opposite side of this fixing portion 22. The neck portion 31 having a concave shape is formed at each of portions opposing the front and rear in the longitudinal direction in the center of the slider body 1 so that the zipper pull 2 is easy to elastically deform.

To prevent the connecting body 3 from being inclined and moved longitudinally when the connecting body 3 having the U letter shape is disposed on the top surface of the slider body 1, protrusions 6 are provided on the right and left of the mounting portion 4 so as to protrude from the top surface of the slider body 1. These protrusions 6 are fitted in between the lateral bars 20 of the U letter shape so as to prevent the zipper pull 2 from being loose.

Figure 8:
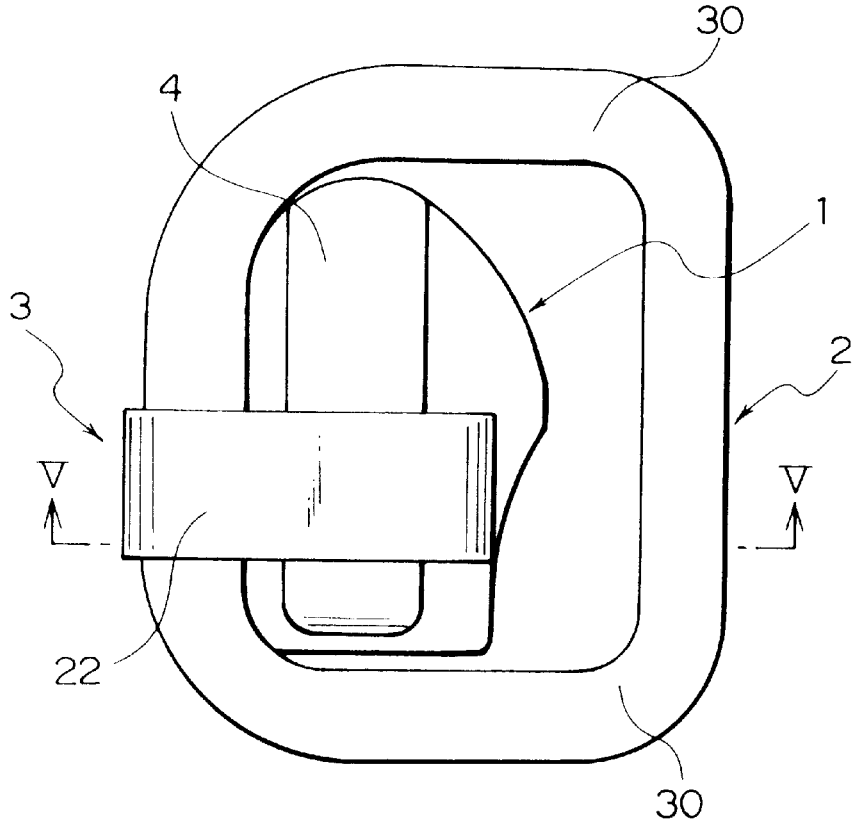
FIG. 8 is a front view of a fastener having a zipper pull of a slider for slide fastener of a fourth embodiment.
Figure 9:
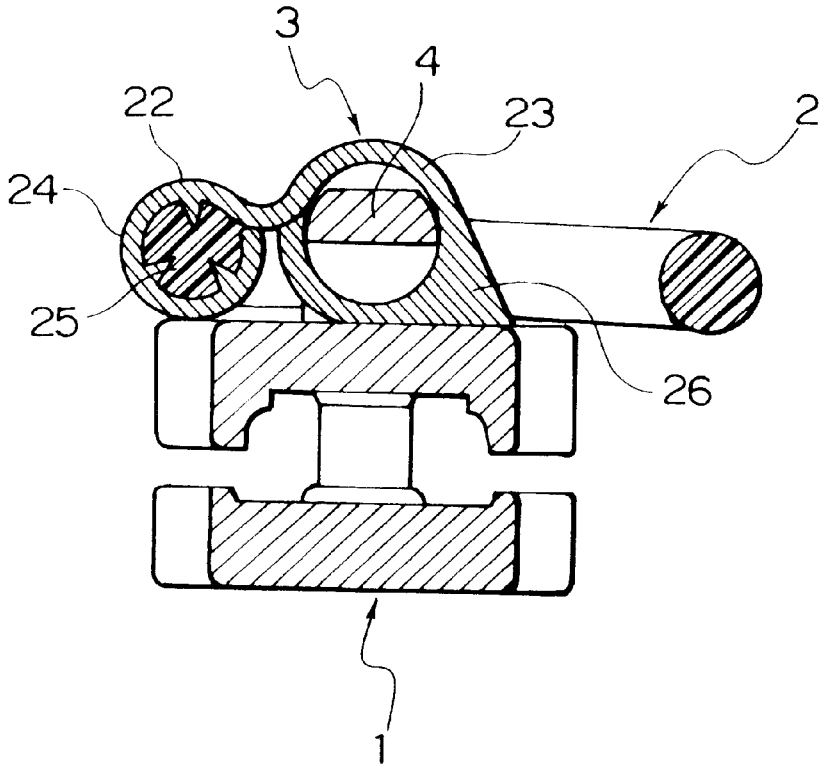
FIG. 9 is a sectional view taken along the line V—V in FIG. 8 of the slider.

Next, a zipper pull of a slider according to a fourth embodiment shown in FIGS. 8 and 9 will be described. The connecting body 3 to be mounted on the slider body 1 is provided with a tongue-like supporting portion 23 which surrounds the zipper pull mounting portion 4 provided on the slider body 1 and to which it can be fitted in a floating state. A tongue-like engaging piece 24 for attaching the zipper pull 2 is connected integrally to a side of this supporting portion 23. Engaging protrusions 25 for capturing the zipper pull 2 of resilient body are provided on an inner face of the engaging piece 24. A portion in contact with the slider body 1 of the supporting portion 23 is provided with a restricting portion 26 which is protruded sideways to prevent the connecting body 3 from swinging when the supporting portion 23 surrounds the zipper pull mounting portion 4 and fits it in the floating state.

Upon mounting the connecting body 3 onto the slider body 1, the connecting body 3 is wound around the zipper pull mounting portion 4 in an annular state so as to surround it such that the restricting portion 26 of the supporting portion 23 is in contact with the slider body 1. Then, the tongue-like engaging piece 24 located at a front end of the connecting body 3 is wound around the zipper pull 2 of resilient body. Then, by piercing the engaging protrusions 25 into the annular zipper pull 2 properly, the fixing portion 22 is formed. This fixing portion 22 is disposed so as to be in contact with the top surface of the slider body 1 to prevent the connecting body 3 from swinging.

Figure 10:
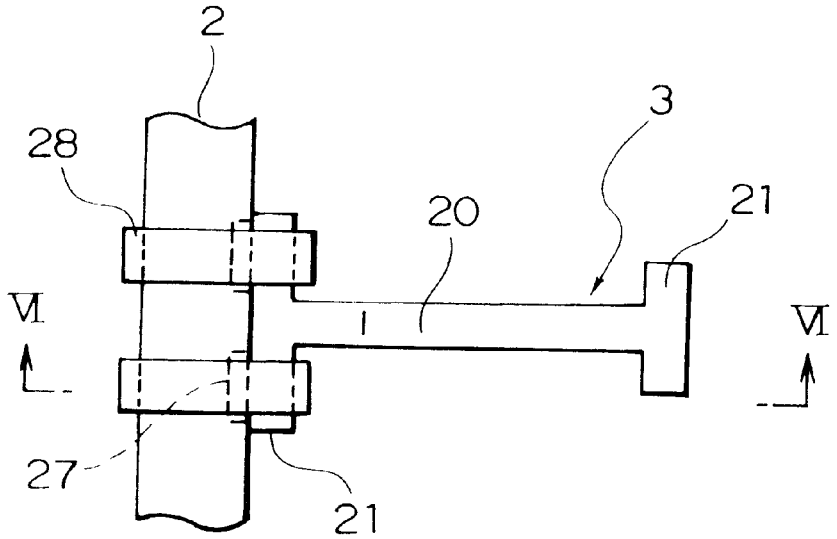
FIG. 10 is a front view showing major portions of a zipper pull of a slider for slide fastener of a fifth embodiment.
Figure 11:
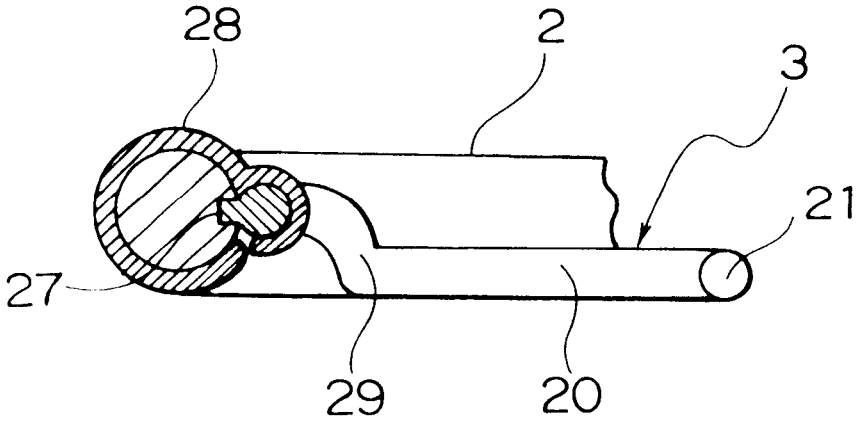
FIG. 11 is a sectional view taken along the line VI—VI in FIG. 10 of the zipper pull.

A zipper pull of a slider according to a fifth embodiment shown in FIGS. 10 to 12 will be described. In the connecting body 3, the vertical bar 21 is connected integrally to each of both ends of the lateral bar 20. Then, engaging portions 27 protruded outward are provided on an outer face of one vertical bar 21. By bending the lateral bar 20 near an end portion thereof provided with the engaging portions 27 at an elevation angle, a bending portion 29 is formed. Further, a front end portion of the bending portion 29 is bent horizontally, so that the engaging portions 27 are protruded horizontally.

The zipper pull 2 formed in an appropriate annular shape of resilient body is placed outside the vertical bar 21 of the connecting body 3 and an tongue-like mounting ring 28 is wound around the vertical bar 21 and the zipper pull 2 and tightened. Consequently, the engaging portions 27 bite into the zipper pull 2 of resilient body so as to form the fixing portion 22 which is fixed firmly.

Figure 12:
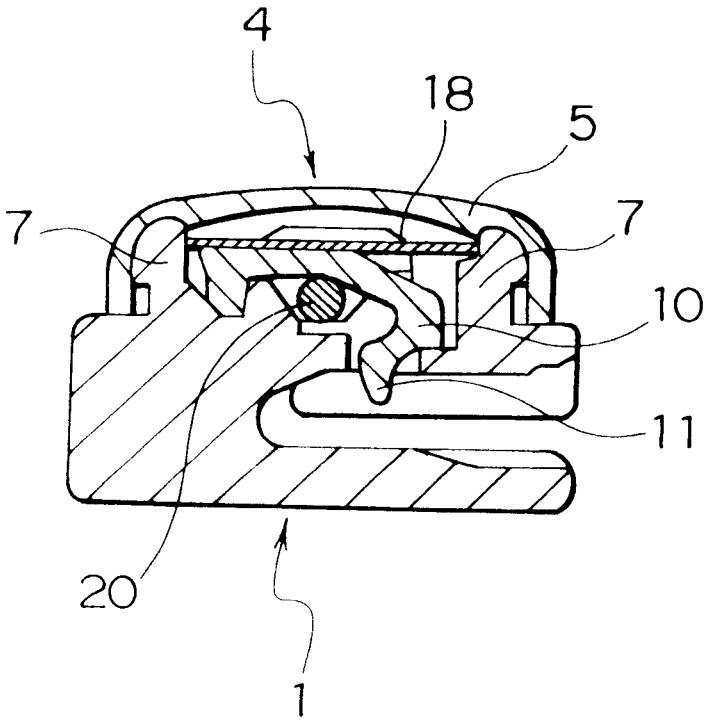
FIG. 12 is a longitudinal sectional view of the slider having the zipper pull of FIG. 10.

This connecting body 3 is mounted on the slider with the automatic locking device as shown in FIG. 12. A leaf spring 18 is placed on a top face of the mounting post 7 provided within the cover body 5 disposed on the top face of the slider body 1 and the locking pawl lever 10 whose locking pawl 11 is protruded downward is disposed below the leaf spring 18. Then, the lateral bar 20 of the connecting body 3 is inserted between the slider body 1 and the locking pawl lever 10. As a result, the slider with the automatic locking device is provided.

When the grip portion 30 at a free end of the zipper pull 2 in this type of the slider is lifted slightly, the lateral bar 20 lifts the free vertical bar 21 slightly off the top surface of the slider body 1. At the same time, the locking pawl lever 10 in the yoke 5 is also lifted up, so that the slider can be slid in any direction of longitudinally.

Figure 13:
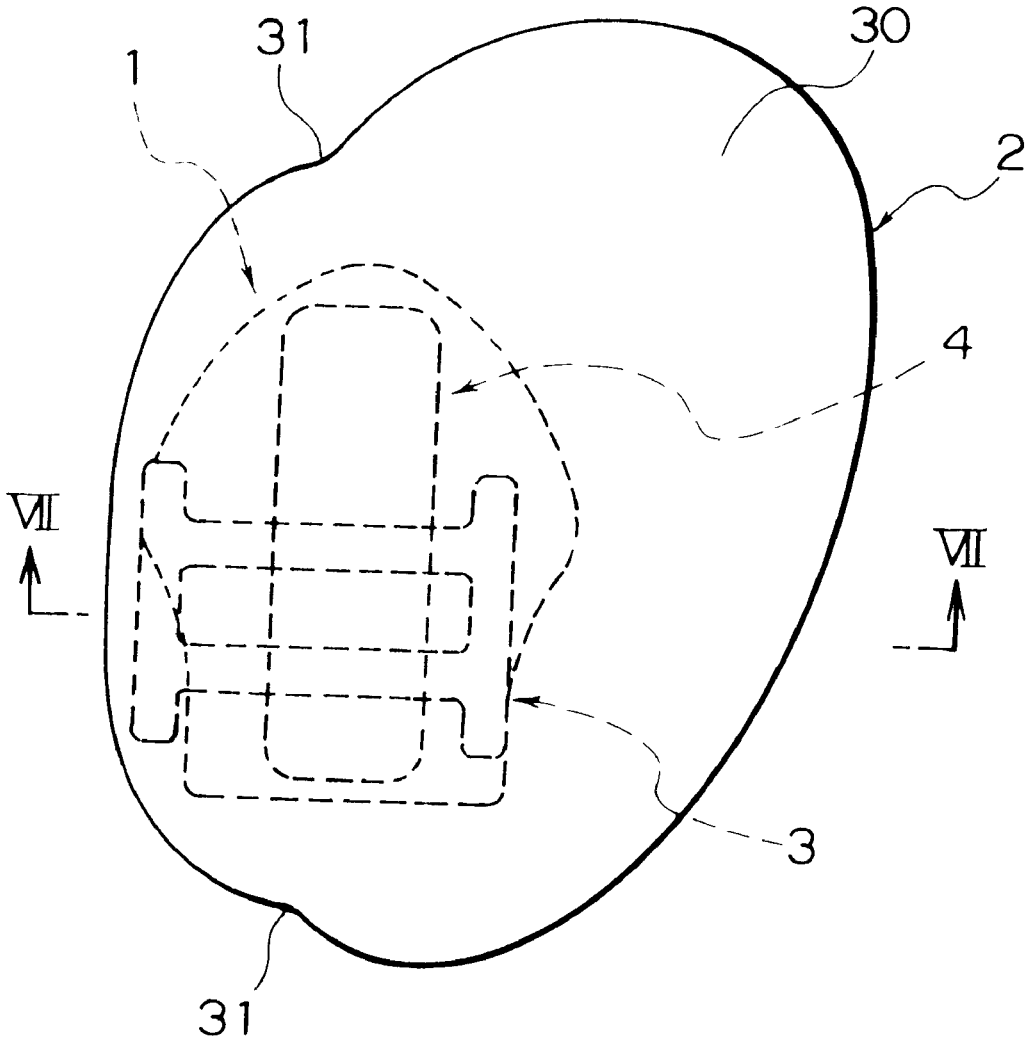
FIG. 13 is a front view of a slider having a zipper pull of a slider for slide fastener of a sixth embodiment.
Figure 14:
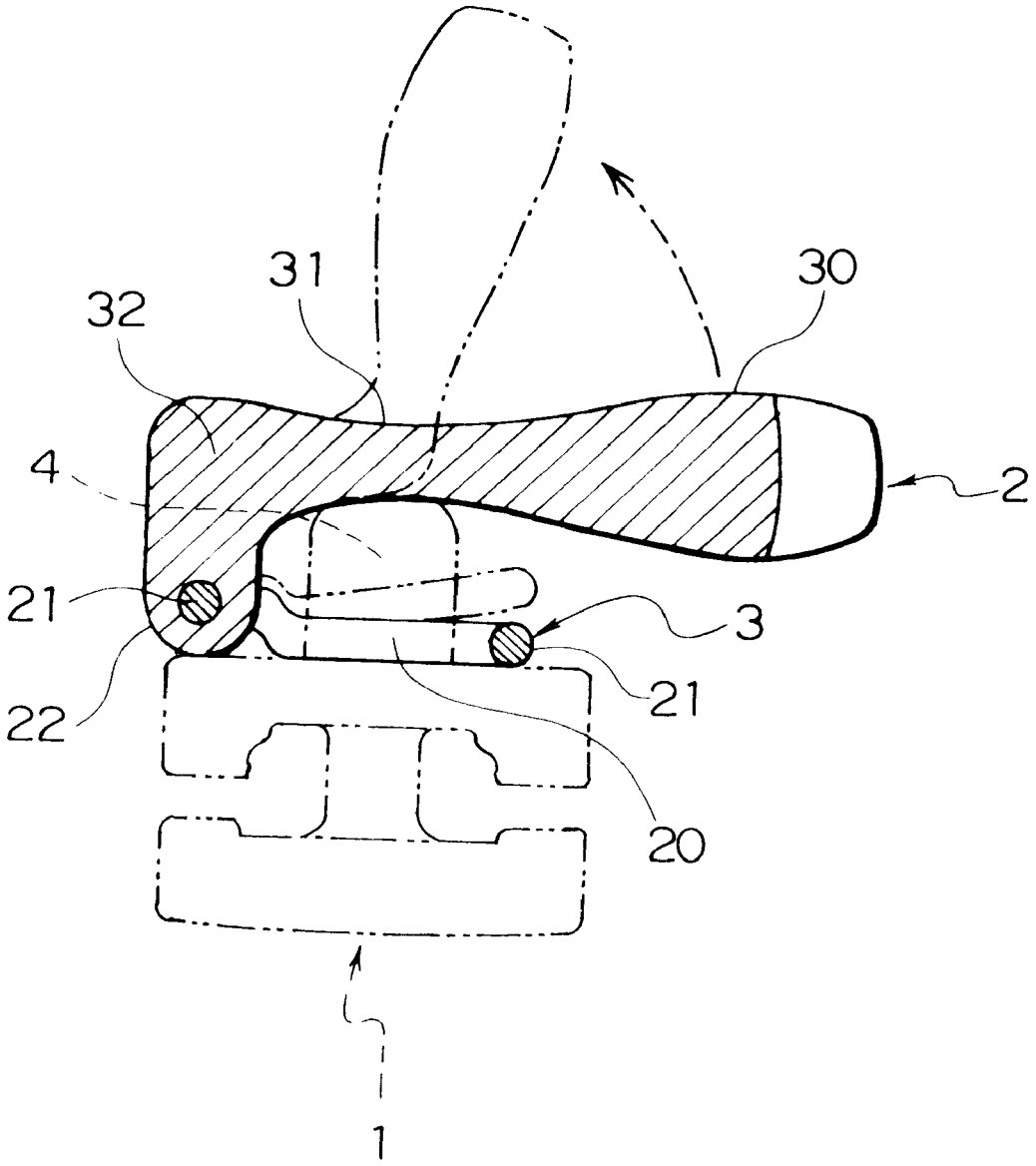
FIG. 14 is a sectional view taken along the line VII—VII showing major portions of the slider of FIG. 13.
Figure 15:
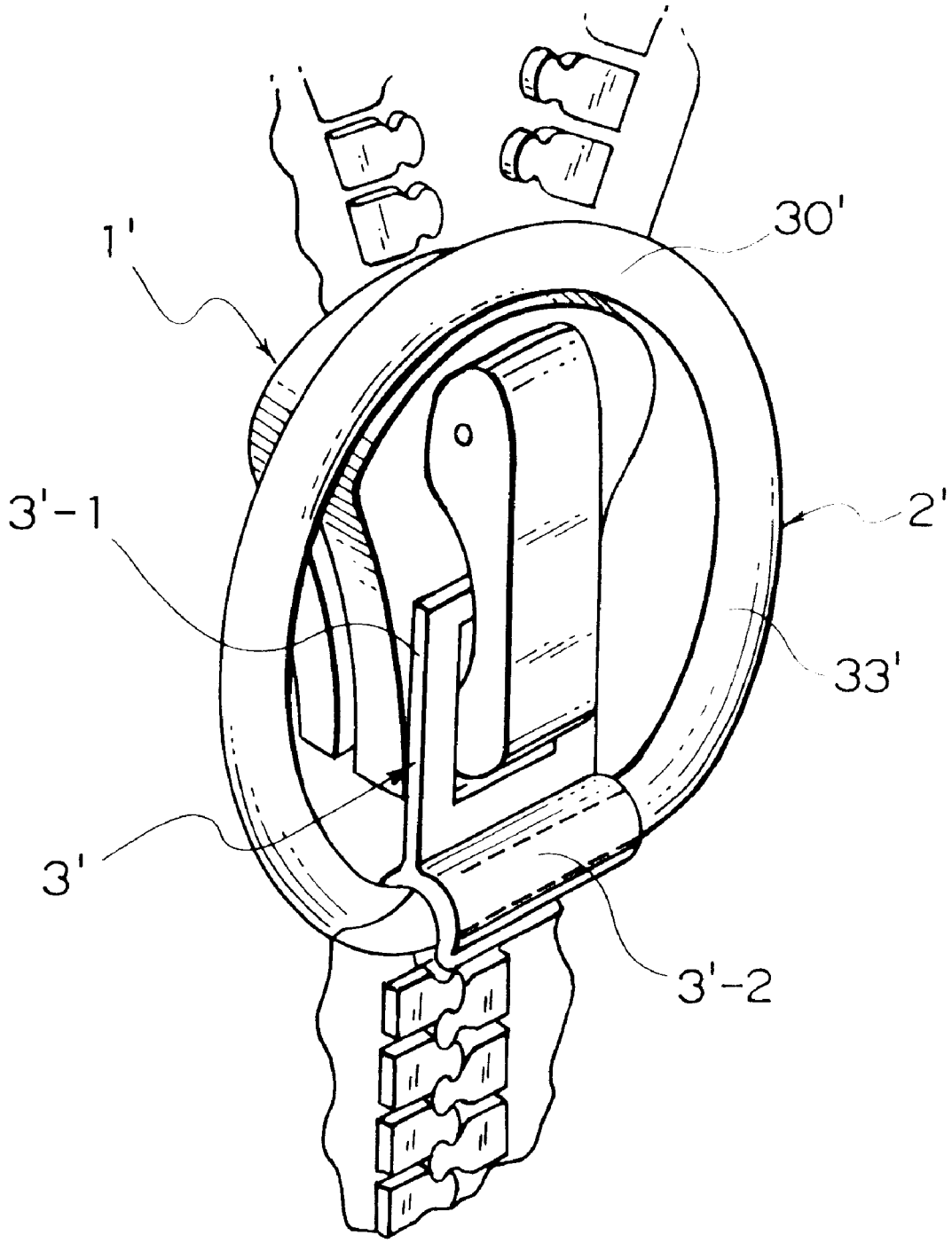
FIG. 15 PRIOR ART
FIG. 15 is a perspective view of a well known slider.

A zipper pull of a slider according to a sixth embodiment shown in FIGS. 13 and 14 will be described. In the connecting body 3 to be mounted on the slider body 1, two lateral bars 20, which can be inserted laterally into the zipper pull mounting portion 4, are arranged in parallel with an interval and then, the vertical bar 21 is connected integrally to each of both ends of the lateral bars 20 such that it is protruded longitudinally. Then, the zipper pull 2 formed of a sheet-like resilient body is attached to one of the vertical bars 21.

Upon mounting the zipper pull 2 of resilient body onto the vertical bar 21, the vertical bar 21 is buried in the sheet-like zipper pull 2 of resilient body so as to form the fixing portion 22. The sheet-like zipper pull 2 is raised substantially at right angle from this fixing portion 22 and then, bent above the fixing portion 22 to form a bent portion 32 so that the zipper pull mounting portion 4 of the slider body 1 is covered horizontally by the zipper pull 2.

In the bent sheet-like zipper pull 2, the neck portions 31 are so formed that the thickness of the zipper pull 2 is decreased above the mounting portion 4 of the slider body 1, so that elastic deformation thereof is facilitated. Further, a front end portion of the zipper pull 2 is formed in a large to be thick so as to form the grip portion 30 which is easy to grip. Meanwhile, this type of the zipper pull 2 can be applied appropriately to the slider with the automatic locking device as well as the free slider like the pervious cases.

The zipper pull of a slider for slide fastener of the present invention has the above described structure and exerts the following effects.

According to the invention, a zipper pull mounting portion 4 is provided on a top face of a sliding body 1, a connecting body 3 is disposed in a lateral direction relative to the zipper pull mounting portion 4 and a zipper pull 2 formed of resilient body is fixed on any side of the right and left of the connecting body 3 so as to form a fixing portion 22, so that the zipper pull 2 is urged to be always fallen on a top face of the slider body 1. Therefore, when the zipper pull 2 of resilient body is lifted up slightly, the fixing portion 22 of the zipper pull 2 is rotated so that a free end of the connecting body 3, which is mounted perpendicularly to the zipper pull mounting portion 4 provided on the slider body 1, can be lifted up easily. Further, the zipper pull 2 of resilient body is not turned so much at a portion fixed to the connecting body 3, so that the zipper pull 2 is not damaged by the turning and capable of bearing a long term use. Further, the zipper pull 2 is maintained in a stabilized condition without swinging freely so that no discomfort is given to a user of the slide fastener.

Further, the zipper pull 2 made of resilient body is formed in an annular shape and a part of the annular portion is fixed to a vertical bar 21 of the connecting body 3 so as to form a fixing portion 22 or the zipper pull 2 made of resilient body is formed in a sheet-like shape and a part of the sheet-like portion is fixed to a vertical bar 21 of the connecting body 3 so as to form a fixing portion 22. Therefore, the zipper pull 2 of resilient body attached to the slider body 1 is of annular or sheet-like shape, so this zipper pull 2 is adaptable for various types of the sliders so as to satisfy diversified user's demands.

And the connecting body 3 is comprised of two lateral bars 20 being capable of being inserted into the mounting portion 4 disposed with an interval, and vertical bars 21 being protruded longitudinally from each of both ends of the lateral bars 20 molded integrally with the lateral bars 20. Therefore, there is such an effect that the connecting body 3 can be formed with a simple structure and further, the connecting body 3 is prevented from being inclined longitudinally when the zipper pull 2 is operated, thereby achieving a smooth sliding operation.

And further, the connecting body 3 is placed on a top surface of the slider body 1 such that the fixing portion 22 in which the zipper pull of resilient body is fixed is in contact with the top surface. Thus, the connecting body 3 is so formed that the fixing portion 22 in which the zipper pull 2 of resilient body is fixed can be always placed on the slider body 1, so there is such an effect that the zipper pull 2 of resilient body can be maintained on the slide body 1 in a stabilized state neatly.

Still further, the vertical bar 21 is disposed on one side of the connecting body 3 and the lateral bars 20 of U letter shape are connected to the vertical bar 21 and protrusions 6 provided on the top surface of the slider body 1 are fitted in between the lateral bars 20 disposed on the right and left of the mounting portion 4 provided on the top surface of the slider body 1. Thus, there is such an effect that the connecting body 3 has the U letter shape and can be maintained on the slider body 1 in a stabilized state. Further, there is such an effect that an inclination of the connecting body 3 longitudinally upon operation is prevented with a simple structure thereby achieving a smooth sliding operation.

And the connecting body 3 has an annular supporting portion 23 to which the mounting portion 4 can be fitted provided on the top surface of the sliding body 1 in a floating state, a restricting portion 26 protruded over the top surface of the slider body 1 is provided on the outer side of the supporting portion 23 and the fixing portion 22 in which the zipper pull 2 of resilient body is fixed is provided on an opposite side to said restricting portion. Thus, there is such an effect that the connecting body 3 can be fitted to the mounting portion 4 with a gap and further, the connecting body 3 is prevented from being inclined longitudinally when the zipper pull 2 is operated, thereby achieving a secure and smooth sliding operation.

And further, the connecting body 3 is comprised of a lateral bar 20 and vertical bars 21 connected to both ends thereof, engaging portions 27 are provided on one vertical bar 21 such that they are protruded outward thereof, and the zipper pull 2 of resilient body is fixed to the engaging portions 27 by means of a mounting ring 28. Thus, there is such an effect that the annular zipper pull 2 formed of resilient body easily can be attached to the connecting body 3 having a simple structure firmly.

Still further, the lateral bars 20 of the connecting body 30 are inserted into an automatic locking pawl lever 10 provided within a yoke 5 mounted on the top surface of the slider body 1 so that the locking pawl lever 10 is capable of being lifted up. Thus, there is such an effect that the connecting body 3 can be easily applied to the slider having the automatic locking mechanism with a simple structure.

Further, the vertical bar 21 disposed on one side of the connecting body 3 is buried and fixed in the zipper pull 2 of resilient body so as to form the fixing portion 22. Thus, there is such an effect that the connecting body 3 can be fixed to the zipper pull 2 of resilient body very simply and firmly.

And the zipper pull 2 of resilient body contains narrow or concave neck portions 31 in a longitudinal direction in the center of the slider body 1. Thus, there is such an effect that the fixing portion 22 is not affected so much by elastic deformation thereby achieving a secure operation.

And further, the zipper pull 2 of resilient body formed in an annular shape, contains a grip portion 30 whose diameter is increased or which has an increased thickness on an opposite side to the fixing portion 22 in which the connecting body 3 is fixed. Thus, there is such an effect that the grip portion 30 having a simple structure and being easy to operate can be formed easily in the zipper pull 2 of resilient body.

Still further, the zipper pull 2 of resilient body forms a grip portion 30 on an opposite side to the fixing portion 22 formed in an annular shape and in which the connecting body 3 is fixed, such that a space is expanded obliquely forward or the zipper pull 2 of resilient body is formed in annular D letter or inverted D letter shape and has a grip portion 30 on an opposite side to the fixing portion 22 in which the connecting body 3 is fixed, such that a space is expanded vertically. Thus, there is such an effect that the grip portion 30 having a simple structure and which can be pulled effectively can be formed in the annular zipper pull 2 of resilient body.

And the zipper pull 2 of resilient body is formed in a sheet-like shape and raised from the fixing portion 22 and bent to cover the mounting portion 4 so as to form a bent portion 32. Thus, there is such an effect that the sheet-like zipper pull 2 of resilient body can be attached to various types of the sliders with a good appearance and can be operated extreamly easily.

And further, the zipper pull 2 of resilient body is formed of natural rubber, synthetic rubber or thermoplastic elastomer. Thus, there is such an effect that the annular or sheet-like zipper pull 2 of resilient body can be formed easily of material capable of being elastically deformed and that an effective elastic force can be exerted. Therefore, the effects exerted by the invention are extreamly remarkable.

What is claimed is:

1. A zipper pull of a slider for a slide fastener comprising:

a zipper pull mounting portion provided on a top face of a slider body; and a connecting body disposed in a lateral direction relative to the zipper pull mounting portion, wherein the zipper pull is formed of resilient material and is fixed on a side of the connecting body so as to form a fixing portion, so that the zipper pull is laterally urged toward the top face of the slider body via the connecting body.

2. The zipper pull of claim 1, wherein the connecting body is comprised of two lateral bars disposed with an interval and being capable of being inserted into the mounting portion, and vertical bars molded integrally with each of both ends of the lateral bars and being protruded in back and forth direction from the lateral bars.

3. The zipper pull of claim 1, wherein the connecting body is placed on the top surface of the slider body such that the fixing body in which the zipper pull is fixed is in contact with the top surface.

4. The zipper pull of claim 1, wherein a vertical bar is disposed on one side of the connecting body and the lateral bars are U-shaped and connected to said vertical bar while protrusions provided on the top surface of the slider body are fitted in between the lateral bars disposed on the right and left of the mounting portion provided on the top surface of the slider body.

5. The zipper pull of claim 1, wherein the connecting body has an annular supporting portion to which the mounting portion can be fitted provided on the top surface of the slider body in a floating state, a restricting portion protruded over the top surface of the slider body is provided on the outer side of the supporting portion and the fixing portion in which the zipper pull is fixed is provided on an opposite side of said restricting portion.

6. The zipper pull of claim 1, wherein the connecting body is comprised of a lateral bar and vertical bars connected to both ends thereof, engaging portions are provided on one vertical bar such that they are protruded outward thereof, and the zipper pull is fixed to said engaging portions by means of a mounting ring.

7. The zipper pull of claim 1, wherein the lateral bars of the connecting body are inserted into an automatic locking pawl lever provided within a yoke mounted on the top surface of the slider body so that the locking pawl lever is capable of being lifted up.

8. The zipper pull of claim 1, wherein the zipper pull is formed of natural rubber, synthetic rubber or thermoplastic elastomer.

9. The zipper pull of claim 1, wherein the zipper pull is formed in a flat shape and a part of the zipper pull is fixed to a vertical bar of the connecting body so as to form a fixing portion.

10. The zipper pull of claim 9, wherein the zipper pull is formed in a flat shape and raised from the fixing portion and bent to cover the mounting portion so as to form a bent portion.

11. The zipper pull of claim 1, wherein the zipper pull is formed in an annular shape and a part of the annular portion is fixed to a vertical bar of the connecting body so as to form a fixing portion.

12. The zipper pull of claim 11 or 9, wherein the vertical bar provided on one side of the connecting body is buried and fixed in the zipper pull so as to form the fixing portion.

13. The zipper pull of claim 11 or 9, wherein the zipper pull contains narrow or concave neck portions in a longitudinal direction in the center of the slider body.

14. The zipper pull of claim 11 or 9, wherein the zipper pull contains a grip portion whose diameter is increased or which has an increased thickness on an opposite side to the fixing portion in which the connecting body is fixed.

15. The zipper pull of claim 11, wherein the zipper pull contains a grip portion on an opposite side of the fixing portion formed in an annular shape and in which the connecting body is fixed, such that a space is expanded obliquely forward.

16. The zipper pull of claim 11, wherein the zipper pull is formed in an annular D-shape or an inverted D-shape and has a grip portion on an opposite side of the fixing portion in which the connecting body is fixed, such that a space is expanded longitudinally.

* * * * *